US005102540A

United States Patent [19]

Conradi et al.

[11] Patent Number: 5,102,540

[45] Date of Patent: Apr. 7, 1992

[54] CATAMARAN ADAPTED SYSTEM FOR REMOVING LIQUID CONTAMINANTS FROM THE SURFACE OF WATER

[76] Inventors: Trond Conradi, 108 Little John Rd., Williamsburg, Va. 23185; Bjornar Helgesen, 2717 NE. 7th Ct., Fort Lauderdale, Fla. 33306

[21] Appl. No.: 568,992

[22] Filed: Aug. 17, 1990

[51] Int. Cl.[5] ..... E02B 15/04

[52] U.S. Cl. ..... 210/232; 210/239; 210/242.3; 210/923

[58] Field of Search ..... 210/242.3, 923, 232, 210/239, 776; 405/66, 67

[56] References Cited

U.S. PATENT DOCUMENTS

| | | | |
|---|---|---|---|
| 1,397,891 | 11/1921 | Jones | 210/242.3 |
| 3,737,040 | 6/1973 | Brydoy et al. | 210/923 |
| 3,915,864 | 10/1975 | Massei | 210/242.3 |
| 3,966,613 | 6/1976 | Kirk et al. | 210/923 |
| 4,058,461 | 11/1977 | Gaw | 210/923 |
| 4,073,143 | 2/1978 | Preuss | 210/923 |
| 4,100,072 | 7/1978 | Uchida et al. | 210/242.3 |
| 4,120,793 | 10/1978 | Strain | 210/923 |
| 4,209,400 | 6/1980 | Mayes | 210/242.3 |
| 4,388,188 | 6/1983 | Morris | 210/923 |

FOREIGN PATENT DOCUMENTS 1379256 1/1975 United Kingdom .

*Primary Examiner*—Stanley S. Silverman
*Assistant Examiner*—Christopher Upton
*Attorney, Agent, or Firm*—Malin, Haley, McHale, DiMaggio & Crosby

[57] ABSTRACT

A kit for converting a conventional passenger catamaran into an efficient liquid pollutant collector is disclosed. The kit includes a plurality of booms, removably extending forward of and away from the outermost of the hulls of the catamaran. The booms extend essentially parallel to the water and form essentially a V-shape extending away from the hulls of the catamaran. Skirts to contain the liquid pollutant between the booms and direct the liquid pollutant rearward are attached to and extend downward into the water from the booms. Also included is a wall which extends a short distance into the water between and near the stern of the hulls of the catamaran. In addition, a pump is connected to a manifold, which opens onto the surface of the water in front of the wall. The pump removes the liquid pollutant from the surface of the water through the manifold and moves the liquid pollutant into either a storage container or a processing system.

13 Claims, 1 Drawing Sheet

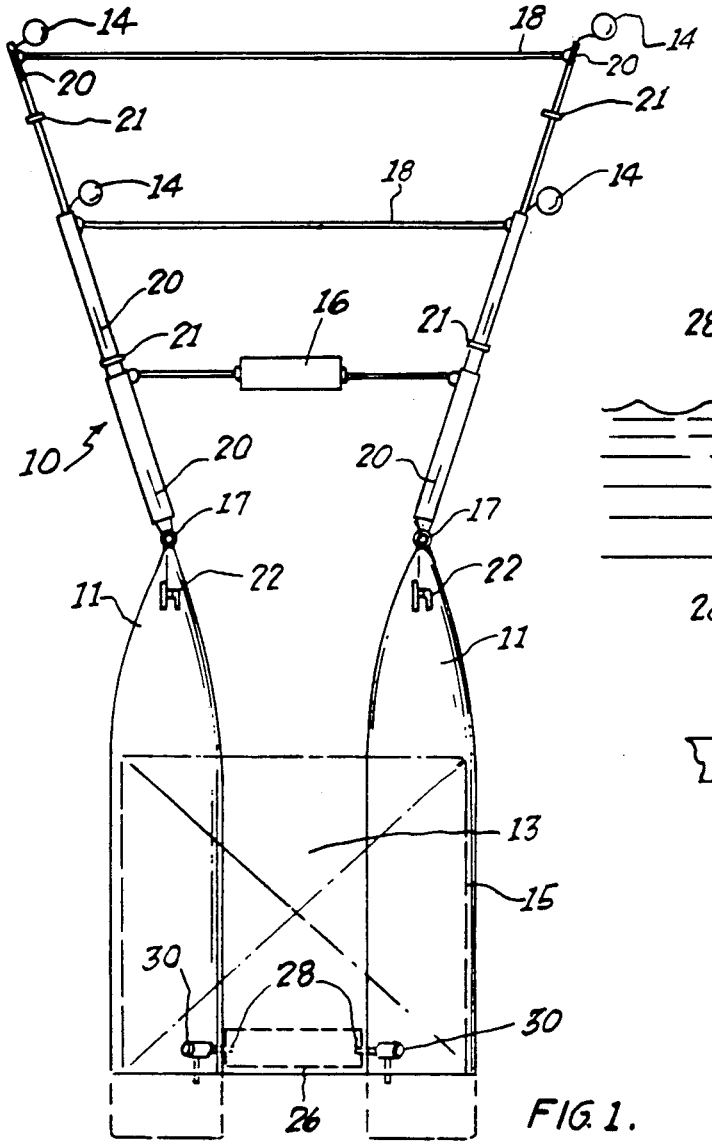
FIG. 1.
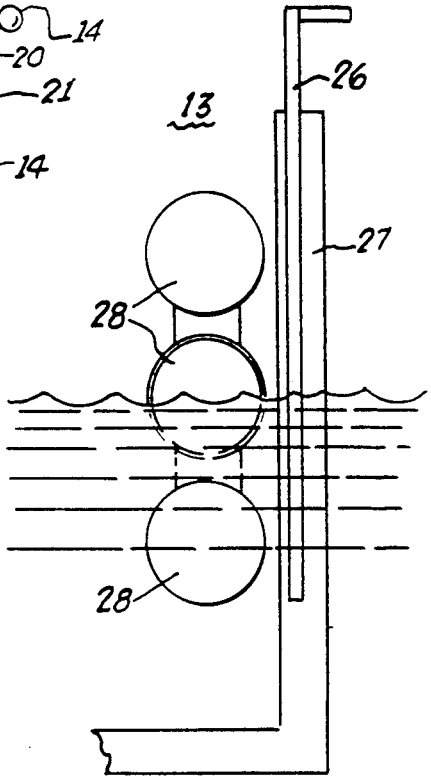
FIG. 2.
FIG. 3.
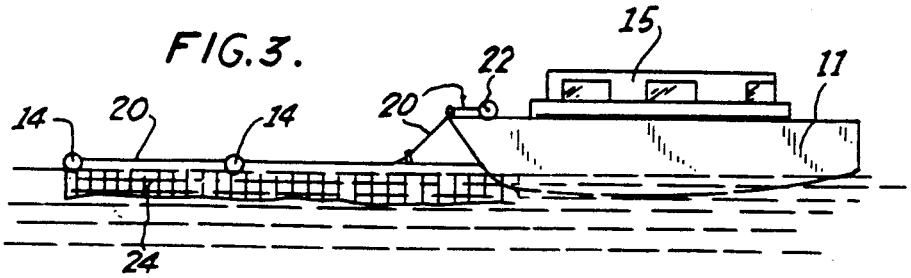

CATAMARAN ADAPTED SYSTEM FOR REMOVING LIQUID CONTAMINANTS FROM THE SURFACE OF WATER

BACKGROUND OF THE INVENTION

1. Field of the Invention

This invention relates to devices for removing liquid contaminants, particularly oil, from the surface of the ocean, sea or other similar body of water, and more particularly to a system used in combination with an ordinary passenger catamaran vessel for removing such contaminants from the surface of water whereby an ordinary passenger catamaran is quickly adapted to become an efficient remover of contaminants.

2. Related Art

It has become an unfortunate fact of modern existence that oil spills from oil tankers or from oil drilling derricks and the like are a fairly common occurrence. The effect of these oil spills can be catastrophic on the environment, particularly where the oil slick is allowed to reach land. For this reason, it is important to contain and remove the oil spill as soon as possible after it is spilled into a body of water. If the oil spill is not contained at this early stage, then because of its size and the prevailing water and weather conditions, it typically becomes much more difficult to contain and remove the oil slick which then becomes likely to cause serious environmental damage.

Several devices have been devised to contain and remove the oil from an oil slick or debris from the surface of the water. Exemplary of these are U.S. Pat. Nos.:

3,915,864, issued to Massei, Oct. 28, 1975
3,966,615, issued to Petchul et al., June 29, 1976
4,108,773, issued to Macaluso, Aug. 22, 1978
4,128,068, issued to Ogura et al., Dec. 5, 1978
4,551,244, issued to Inoue, Nov. 5, 1985
4,795,567, issued to Simpson et al., Jan. 3, 1989

These patents all disclose devices whose exclusive use is in removing polluting material from the water, particularly oil. Consequently, these prior art devices have the deficiency of having no other usable purpose while waiting for an oil spill to occur. The lack of multiple uses for these vehicles while waiting for oil spills to occur is a problem in want of a solution.

The previous vessels employed generally also suffer from an inability to rapidly move from where they are to the site of the oil spill. Those vessels which are self-powered are not adapted for high speed travel from wherever they may be located to the oil spill site. Those devices which may be dismantled and transported to the site of the oil slick are relatively cumbersome and consequently not easy to transport. The inability of these prior art devices to rapidly and easily respond to an oil spill site is also a problem in want of a solution.

It is in view of these and other problems and objectives which will become clear hereafter that the instant invention was created.

SUMMARY OF THE INVENTION

A conventional passenger-type catamaran or other multi-hull vessel capable of sustained speeds in some instances in excess of fifty knots is combined with an attachable and removable, easily storable, system for removing liquid material from the surface of a body of water. Basically, two telescopic booms are attached to the front of the catamaran's hulls. Flexible skirts are removably attached along the booms which descend into the water to form a containment chamber between the two booms. The containment chamber also directs the oil to the space between the catamaran hulls. Balloons are attached to its booms to float the booms on the surface of the water. An hydraulic adjuster is placed between the booms to determine the relative angle of the booms. Security wires are strung between the booms at the end of the booms farthest from the catamaran hulls to keep the booms from spreading too far apart in response to wave action and the movement of the catamaran through the water.

Pull back wires are attached to each of the far ends of the telescoping booms. The other ends of the pull back wires are attached to a winch located at the hulls of the catamaran. When the telescoping booms are to be collapsed, the pull back wire is winched onto the winch, thereby collapsing the collapsible telescoping booms. The flexible skirt may also be contracted with the telescoping boom collapsing in an accordion-like fashion.

At the rear of the space between the catamaran hulls is an adjustable wall which moves up and down to predetermined depths in the water. The purpose of the wall is to create a collection space for the oil to build up to an appreciable depth. A series of closable manifolds are placed at different vertical levels along the inside of both of the catamaran's hulls. These manifolds are connected to pumps which draw the oil collected in front of the wall through the pumps and consequently into either storage containers or a processing system.

In operation, the catamaran with the telescoping booms extended and the skirts dropped into the water is slowly driven through the oil slick causing the oil to be funneled into the space between the catamaran's hulls. The oil will begin to accumulate at the wall where it can be pumped through the manifolds into the storage containers or to a processing system.

When not equipped with the boom assembly and the rear wall, the conventional passenger catamaran may be used, as is common for such catamarans, to ferry passengers to various sites. However, in the event of an oil spill, the catamaran can rapidly travel to the site of the oil spill where the telescoping boom and skirt assembly may be rapidly attached to the bows of the catamaran hulls. In addition, the rear wall will be placed between the sterns of the hulls to create an oil chamber.

In the preferred embodiment, only the manifolds and pump are permanently attached and remain on the catamaran while it is being used as a passenger vehicle. The boom assembly and rear wall may be stored on board the catamaran or may be transported to the oil slick site when needed. Although the manifolds and pumps are built into the existing passenger catamaran, the amount of space they take up and the weight they add to the catamaran is minimal. Therefore, the addition of this manifold and pump system to the passenger catamaran will have a diminimus effect on its ability to operate as a passenger catamaran.

BRIEF DESCRIPTION OF THE DRAWINGS

FIG. 1 is a schematic plan view of the system.

FIG. 2 is a side elevational view of the device in FIG. 1.

FIG. 3 is a side elevational view along the line 3—3 of FIG. 1

DETAILED DESCRIPTION OF THE INVENTION

The combination conventional passenger catamaran and oil collector system is shown in FIG. 1 generally designated as 10. The conventional passenger catamaran has two hulls 11 which define a space 13 between them. Because the hulls 11 rest partially below and partially above the water, the space 13 between them will generally consist of water at the lower portions of the hulls 11 and air at the upper portions. A passenger compartment 15, as best shown in FIG. 2 spans the hulls 11 above space 13. In respect to structure and function, the passenger catamaran, when not being used as an oil spill collector, is in every respect an ordinary passenger catamaran, with the following modifications: boom connectors 17 are attached to the outside of the hulls at the front of the hulls 11; guides 27, are placed, one on each side inside of the catamaran hulls 11 at the rear of the space 13 between the catamaran hulls 11; several closable manifolds 28 are placed in a vertical alignment along each of the catamaran hulls 11 just forward of the guides 27.

Boom connectors 17 allow telescoping tubular booms 12 to be attached to the front of the catamaran hull 11. These boom connectors 17 can be of any common type that allows pivoting of the booms 12 about the boom connector 17 such as a hinged clevis and pin. In addition, boom connectors 17 also allow the booms 12 to be readily and easily removable from the boom connectors 17.

Guides 27 allow a wall 26 to be securely inserted transverse to the direction of the catamaran hulls 11. Guides 27 contain any common means for adjusting the height of the wall 26 relative to the water as shall be explained hereafter.

Manifolds 28 are connected through pipes to pumps 30 which draw the liquid oil and water mixture accumulating in front of wall 26 through manifolds 28 and pumps 30 where the oil and water mixture may be pumped into oil and water storage containers or into a processing system. An ideal water and oil storage container is the Dracone which is disclosed and claimed in my currently pending U.S. patent application Ser. No. 07/568,993 filed Aug. 17, 1990 is the name of Trond Conradi and Hugh Williams.

In response to an oil spill, the conventional passenger catamaran may rapidly proceed at full speed to the site of the oil spill. Once at the site, telescoping booms 12, which may have been stored on board the catamaran or brought to the site of the oil slick, may be attached to the boom connectors 17 at the front of the catamaran hulls 11. The telescoping booms 12 are then extended and locked in their full extended length as shown in FIG. 1. The locking may be by any common means for locking such telescoping booms.

Attached to the bottom of these telescoping booms 12 are flexible skirts 24. The skirts 24 are preferably attached along their top surface by a slot and groove arrangement to the underside of the telescoping booms 12 such as is common to attach sails to masts on sailboats. These flexible skirts are ideally made of a plastic sheet material and extend downward from the booms into the water about twelve inches. The flexible skirts 24 may be weighted at their lower edges to hold them in place in the water.

At various places along the telescoping booms 12 are balloons 14 which may be filled with air. These balloons 14 are attached to the telescoping booms 12 and support them on the water so that the telescoping booms 12 float on the surface of the water.

An hydraulic adjuster 16 is placed between the telescoping booms 12. The hydraulic adjuster may either extend outward or inward under hydraulic pressure controlled by an operator, thereby pushing or pulling the telescoping booms either farther away or closer together, respectively. In this way, the shape of the funnel-shaped area between the telescoping booms 12 and the skirts 24 is controlled. Security wires 18 are preferably placed between the telescoping booms 12 at various places along the length of the extended telescoping boom to prevent the telescoping booms from being bent excessively outward in response to wave action or the movement of the boat through the water.

A pull back wire 20 extends along the top surface of each of the telescoping booms 12. The pull back wire 20 is rigidly attached at the end of telescoping boom 12 furthest from the catamaran hulls 11. Retaining rings 21 are placed along the length of telescoping booms 12 allowing the pull back wire 20 to move through them, but firmly positioning the pull back wire 20 along the top surface of the telescoping booms 12. A winch 22 is placed on the hulls 11 which winches the pull back wire 20 and consequently the telescoping booms 12 into a collapsed relation near the catamaran hulls 11. Because the flexible skirts are attached underneath the telescoping booms 12, when the telescoping booms 12 are collapsed, the flexible skirts 24 will also collapse into an accordion shape. When the telescoping booms are in their most collapsed position, the flexible skirts 24 may then be removed from the slot and groove arrangement on the underside of the telescoping beams 12.

In operation, wall 26 is placed in guides 27 between catamaran hulls 11. The wall 26 is adjusted downward into the water to a depth of about ten inches. This allows the wall 26 to skim the top surface of the water thereby collecting any oil which may be present while not presenting an appreciable amount of drag to the forward operation of the device.

Manifolds 28 are placed in vertical arrangement in front of the wall 26 along the inside sides of the catamaran hulls 11. These manifolds are typically six to eight inches in diameter and are selectably openable so that the manifold corresponding to the oil level in the space 13 between the catamaran hulls 11 may be opened to receive the oil mixture. Manifolds 28 are connected to pumps 30 which draw the oil collected in the space 13 in front of wall 26 through the pumps 30 where it may be put into oil and water storage containers or sent to a processing system. It has been found that the water line between the catamaran hulls 11 stays essentially constant despite wave movement around the device 10. For this reason, once an appropriate manifold 28, corresponding to the level of the oil relative to the manifolds 28 has been determined, that manifold 28, when opened, will continue to provide an opening for the oil to be pumped through the pumps 30. The relative position of the manifold 28 and the oil will be a function of the weight of the catamaran and its corresponding position in the water.

In operation, once the passenger catamaran has proceeded rapidly to the site of the oil spill, the telescoping boom 12 and skirt 24 as well as the wall 26 will be placed in operational position as described above. The device 10 then proceeds slowly through the water collecting oil between the telescoping booms 12 and skirts 24 and directing it to space 13 between catamaran hulls 11. The oil will begin to collect at the wall 26 where it may be removed through manifolds 28 into pumps 30.

In this way, a conventional passenger catamaran, which is primarily used for the transportation of passengers, is readily and easily adaptable to a secondary purpose of removing oil from an oil spill. In addition, due to the simplicity of the system, both in assembly and operation, an ordinary passenger catamaran crew could easily assemble and operate the system with a minimum of training.

Although a catamaran vessel has been described, the invention can employ other multi-hulled vessels such as a trimaran or four hulled vessel using the collection system described herein.

The instant invention has been described in connection with a two hull catamaran. The instant invention may also be used with a three hull trimaran by attaching the telescoping booms 12 to the outside hulls of the three hull catamaran by the method described herein. In addition, two walls 26 are used instead of one; each wall 26 extending between a respective outside hull and the central hull. Corresponding manifolds 28 and pumps 30, as described herein, may be placed in relation to walls 26, also as described herein.

The instant invention has been described in connection with adapting an ordinary passenger catamaran or other multi-hull vessel to become an efficient liquid pollutant collector and remover. However, it is also within the scope of the invention to apply the teachings of this invention to a catamaran or other multi-hull vessel which would be exclusively used to collect and remove liquid pollutants.

The instant invention has also been described in connection with the collection of oil from the surface of water. However, the instant invention is useable to collect any liquid which floats on the surface of the water.

While the present invention has been described in connection with a specific embodiment, it is to be understood that this description has been made by way of example only and not by means of limitation. It is understood that modifications and improvements may be made and still be within the scope of the invention and that obvious modifications will occur to a person skilled in the art.

What is claimed is:

1. In combination with a conventional passenger catamaran having a pair of hulls, a kit for converting said catamaran into an efficient liquid pollutant collector comprising:

a plurality of collapsible booms, each of said booms removably extending forward of and away from the outermost of said hulls of said catamaran, said booms extending essentially parallel to the water, said booms forming essentially a V-shape extending away from said hulls of said catamaran;

means for removably attaching respective said booms to respective said outermost hulls;

means for directing said liquid pollutant into the space between said hulls of said catamaran comprising flexible skirts extending downward along the length of said booms into said water and means for attaching the tops of said skirts to the undersides of said booms;

means for containing said liquid pollutant within the space between said hulls of said catamaran comprising a wall extending into the water between said outermost hulls at the rear of the space between said hulls of said catamaran;

means for removing said liquid pollutant from said means for containing said liquid pollutant within the space between said hulls including at least one pump whereby said liquid pollutant is pumped from said space between said hulls of said catamaran to either a storage container of a processing system.

2. The device of claim 1 wherein said booms are telescopically collapsible.

3. The device of claim 1 wherein said flexible skirts are weighted along their lowermost edges.

4. The device of claim 1 wherein said wall is adjustably extended into the water between said outermost hulls of said catamaran.

5. The device of claim 1 further comprising at least one manifold openable to said liquid pollutant collected in the space between said hulls of said catamaran, said manifold fluidly connected to said pump through means for piping.

6. In combination with a conventional passenger catamaran having a pair of hulls, a kit for converting said catamaran into an efficient liquid pollutant collector comprising:

a plurality of telescopically collapsible booms, each of said booms removably extending forward of and away from the outermost of said hulls of said catamaran, said booms extending essentially parallel to the water, said booms forming essentially a V-shape extending away from said hulls of said catamaran;

means for removably attaching respective said booms to respective said outermost hulls;

means for directing said liquid pollutant into the space between said hulls of said catamaran comprising flexible skirts extending downward along the length of said booms into said water and means for attaching the tops of said skirts to the undersides of said booms, said flexible skirts being weighed along their lowermost edges;

means for containing said liquid pollutant within the space between said hulls of said catamaran comprising a wall extending into the water between said outermost hulls at the rear of the space between said hulls of said catamaran, said wall adjustably extending into the water between said outermost hulls;

means for removing said liquid pollutant from said means for containing said liquid pollutant within the space between said hulls including:

at least one pump; and, at least one manifold, openable to said liquid pollutant collected in the space between said hulls of said catamaran, said manifold fluidly connected to said pump through means for piping, whereby said liquid pollutant is pumped from said space between said hulls of said catamaran to either a storage container or a processing system.

7. A catamaran, having a pair of hulls, for collecting and retrieving liquid contaminants, particularly oil, from the surface of the ocean, sea or other similar body of water comprising:

a plurality of telescopically collapsible booms, each of said booms removably extending forward of and away from the outermost of said hulls of said catamaran extending into the water between said outermost hulls; said booms extending essentially parallel to the water, said booms forming essentially a V-shape extending away from said hulls of said catamaran;

means for removably attaching respective said booms to respective said outermost hulls;

means for directing said liquid pollutant into the space between said hulls of said catamaran comprising flexible skirts extending downward along the length of said booms into said water and means for attaching the tops of said skirts to the undersides of said booms, said flexible skirts being weighed along their lowermost edges;

means for containing said liquid pollutant within the space between said hulls of said catamaran comprising a wall extending into the water between said outermost hulls at the rear of the space between said hulls of said catmaran, said wall adjustably extending into the water between said outermost hulls;

means for removing said liquid pollutant from said means for containing said liquid pollutant within the space between said hulls including:

at least one pump; and, at least one manifold, openable to said liquid pollutant collected in the space between said hulls of said catamaran, said manifold fluidly connected to said pump through means for piping, whereby said liquid pollutant is pumped from said space between said hulls of said catamaran to either a storage container or a processing system.

8. In combination with a motor powered catamaran having a pair of hulls, an apparatus for converting said catamaran into an efficient liquid pollutant collector from the surface of an ocean, lake, or sea comprising:

a plurality of telescopically collapsible booms, one boom removably connected at one boom end to a forward end of each hull, each of said booms removably extending forward of and away from the outermost of said hulls of said catamaran, said booms extending essentially parallel to the water, said booms forming essentially a V-shape extending away from said hulls of said catamaran;

floatable means for supporting said plurality of booms on said water, said means for supporting attached to said booms;

means for adjusting the distance between said plurality of booms, said means for adjusting located between said plurality of booms;

means for removably attaching respective said booms to respective same outermost hulls;

means for directing said liquid pollutant into the space between said hulls of said catamaran, said means for directing including flexible skirts extending downward along the length of said booms into said water and means for attaching the tops of said skirts to the undersides of said booms, said flexible skirts being weighed along their lowermost edges;

means for containing said liquid pollutant within said space between said hulls of said catamaran, said means for containing including a wall extending into said water between said outermost hulls at the rear of said space between said hulls of said catamaran, said wall adjustably extending into the said water between said outermost hulls; and means for removing said liquid pollutant from said means for containing said liquid pollutant.

9. The device of claim 8, wherein said means for supporting comprises a plurality of balloons attached to various locations of said plurality of booms.

10. The device of claim 9, wherein said balloons are filled with air.

11. The device of claim 8, wherein said means for adjusting comprises a hydraulic adjuster located between said plurality of booms, said hydraulic adjuster extending either outward or inward.

12. The device of claim 8, further comprising means for preventing said plurality of booms from being excessively bent.

13. The device of claim 12, wherein said means for preventing comprises a plurality of security wires placed between said plurality of booms at various locations along said booms.

* * * * *